United States Patent [19]

Bodine

[11] Patent Number: 4,695,231

[45] **Date of Patent: * Sep. 22, 1987**

[54] SONIC IMPELLER FOR SONIC WELL PUMP

[76] Inventor: Albert G. Bodine, 7877 Woodley Ave., Van Nuys, Calif. 91406

[ * ] Notice: The portion of the term of this patent subsequent to Oct. 11, 2001 has been disclaimed.

[21] Appl. No.: 787,492

[22] Filed: Oct. 15, 1985

[51] Int. Cl.[4] ..... F04F 7/00; B01F 11/00

[52] U.S. Cl. ..... 417/241; 366/600

[58] Field of Search ..... 417/241, 240, 211, 513; 366/600

[56] References Cited

U.S. PATENT DOCUMENTS

| | | | |
|---|---|---|---|
| 61,209 | 1/1867 | Kelly | 417/513 |
| 2,933,050 | 4/1960 | Crowl et al. | 417/513 |
| 3,255,699 | 6/1966 | Bodine Jr. | 417/241 |
| 3,489,066 | 1/1970 | Wilson | 417/513 |
| 4,358,248 | 11/1982 | Bodine | 417/241 |

*Primary Examiner*—Carlton R. Croyle
*Assistant Examiner*—Donald E. Stout
*Attorney, Agent, or Firm*—Edward A. Sokolski

[57] ABSTRACT

Within a tubing string forming a conduit for a well is a rod string having sonically responsive impeller pump elements mounted thereon. The impeller pumps employ an elongated cylindrical structure which is spaced from the inner wall of the conduit to form an elongated annular liquid filled gap between the impeller and the conduit. The rod is sonically driven so that it vibrates resonantly. Valves are formed in the impeller, which in one embodiment may comprise a series of ball elements, in another, may comprise flexible reeds, these valve elements being opened and closed in response to the sonic energy to implement the pumping action, and in a third embodiment may comprise arcuate segments that are free to expand and contract radially in response to the sonic energy. The fluid annulus formed between the impeller and the conduit forms a fluid dynamic seal which effectively prevents leak-back flow past the impeller in view of the inertia provided by this annulus which effectively presents a large acoustic mass reactance to the sonic energy. Thus, such leak-back flow is prevented without the need for sealing engagement between the impeller and the conduit.

10 Claims, 12 Drawing Figures

SONIC IMPELLER FOR SONIC WELL PUMP

This invention relates to sonic pumps for pumping wells and the like and more particularly, to an improved impeller element for use in such a pump.

In my U.S. Pat. No. 4,487,554, issued Dec. 11, 1984, a sonic pump is described which employs a plurality of sonic impeller elements which are spaced along a rod string. The rod string is sonically driven so that it vibrates at a resonant frequency, the sonic energy thus developed in the rod string causing the impeller elements to pump the fluid upwardly through a conduit in which the impeller elements are installed. The impeller elements described in my aforementioned U.S. Pat. No. 4,487,554, employ various types of valving techniques, including a resilient cup-shaped impeller and poppet valve mechanisms. In all of these impellers, close fitting piston ring type seal members which seal against the inner wall of a conduit are employed. Such tight fitting sliding type ring seals have several disadvantages. First, friction and wear is inherent in this type of arrangement. This not only results in energy losses, but also causes deterioration of the impeller elements necessitating repair and replacement of such elements. Further, with sliding contact between the impeller elements and the inner wall of the conduit, it is necessary in order to minimize friction and wear that the inner wall of the conduit be kept smooth presenting as little friction as possible to the impeller. This significantly increases the cost of fabricating and maintaining the conduit employed.

The devices of the present invention eliminate the aforementioned shortcomings of the prior art by employing impeller elements which do not abut like piston rings against the inner wall of the conduit in sealing engagement therewith. This end result is achieved by providing the needed sealing action to back-flow by employing an elongated cylindrical wall in the impeller which forms a narrow annular gap with the inner wall of the conduit, this gap normally being filled with liquid to form a liquid annulus. Due to the inertia of this elongated narrow liquid annulus, a large acoustic mass reactance is presented to the acoustical vibratory force developed which forms a fluid dynamic seal to effectively block leak back flow pass the impeller particularly during the portion of the vibration cycle when the upward impelling impulse is occuring. In this manner, the desired end results are achieved without having to resort to sealing contact between the impeller and the conduit walls thus obviating the aforementioned adverse effects.

It is therefore an object of this invention to eliminate the need for sealing contact between an impeller element and a conduit wall in a sonic pump.

It is a further object of this invention to minimize friction and wear on impeller elements in sonic pumps.

Other objects of this invention will become apparent as the description proceeds in connection with the accompanying drawings of which, FIG. 1 is an elevational view in cross-section of a first embodiment of the invention;

Figure 12:
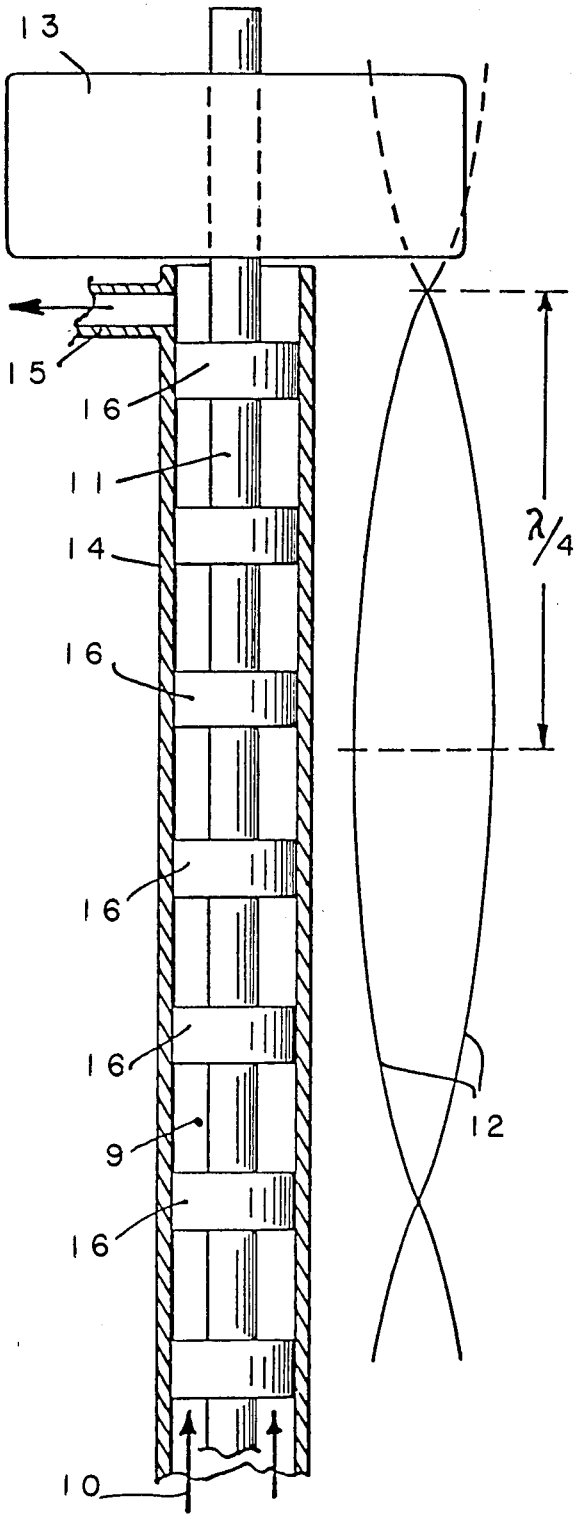
FIG. 12 is a schematic drawing showing a pumping system in which the impeller elements of the invention may be incorporated.

Referring to FIG. 12 a pumping system in which the impeller elements of the invention may be incorporated is schematically illustrated. Rod string 11 is suspended from vibration generator 13 and within tubing string 14. Vibration generator 13 may comprise an orbiting mass oscillator structure and an appropriate rotary drive mechanism of the type described in my U.S. Pat. No. 3,303,782. Rod 11 is solid and is fabricated of a highly elastic material, such as steel. Vibration generator 13 includes an orbiting mass oscillator and a suitable drive mechanism therefor, the vibrational output of the vibration generator being coupled to rod 11. The rod is suspended freely within tubing 14. The orbiting mass oscillator of sonic generator 13 is operated at a frequency such as to cause resonant standing wave vibration of rod 11 as indicated by graph lines 12.

A plurality of sonic fluid impeller units 16 are mounted on rod 11 at spaced intervals therealong, the spacing between adjacent impeller units being substantially less than a quarter wavelength of the speed of sound at the resonant operating frequency at which rod 11 is vibrationally driven. It will be noted that impellers 16 are thus closely interspaced, referring to wave graph 12, such that adjacent impellers and their local regions of the rod are at like-phase regions of the wave pattern motion. An annulus 9 is formed between the inner wall of tubing 14 an the outer wall of rod 11. The vibratory energy in the rod string 11 causes the impellers 16 to impel well fluid up the annular channel 9 as indicated by arrows 10, such fluid being exited from the well through outlet 15. Since the tubing is not part of the vibration system, it can be fabricated of non-elastic material which is generally less expensive than elastic material and, of course, is not critical insofar as its vibrational properties are concerned.

Figure 1:
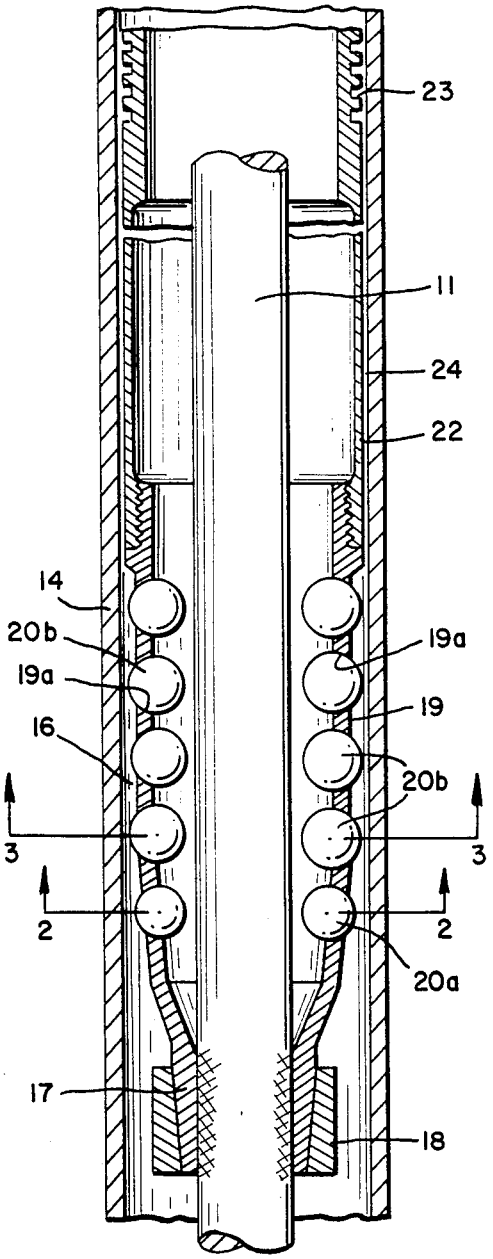
Figure 2:
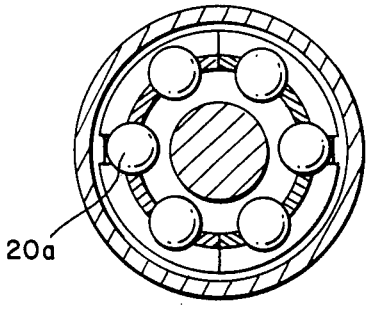
FIG. 2 is a cross-sectional view taken along the plane indicated by 2—2 in FIG. 1.
Figure 3:
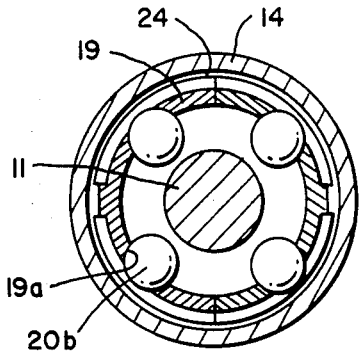
FIG. 3 is a cross-sectional view taken along the plane indicated by 3—3 in FIG. 1.

Referring now to FIGS. 1–3, a first embodiment of the invention is illustrated. The impellers of the present invention employ the same basic sonically driven rod as in my U.S. Pat. No. 4,487,554, and the disclosure of that patent is incorporated herein by reference to provide a disclosure of this portion of the invention. Thus, the same type of sonic oscillator as shown in my '554 patent may be employed and the same type of solid rod member which is resonantly vibrated to develop the sonic energy for the pumping action. So, also, as in the device of my aforementioned patent, the sonic impeller elements may be spaced along the rod member in an optimum manner at intervals which are less than a quarter wavelength at the resonant vibration frequency of the rod string. The impeller elements of the present invention, however, are substantially different from those described in my prior patent and are the subject of the present invention.

As shown in FIGS. 1–3, solid rod member 11 is suspended within conduit 14 which forms the channel for pumping the fluid in a well in which the conduit is installed. The impeller unit 16 may be fabricated of a suitable resilient plastic material such as nylon or polyethelyne. Impeller 16 has a narrowed down neck portion 17 which is tightly clamped to rod 11 by means of clamp member 18 which may be in the nature of a circular hose clamp. The outer surface portion of rod 11 opposite neck portion 17 may be appropriately striated to improve the gripping action. Cylindrical wall portion 19 of the impeller has a plurality of circular valve seats 19*a* formed therein which ball valves 20*a* and 20*b* are seated as best can be seen in FIGS. 2 and 3. These valves may include a single set of six smaller ball valves 20*a* as shown in FIG. 2, and four sets of larger ball valves 20*b* as shown in FIG. 3.

The impeller member has an elongated cylindrical wall portion 22 which typically may be the order of 2–3 feet in length. This wall portion further has annular grooves 23 formed in a portion thereof which forms a labyrinth dynamic seal to further impede the back flow of liquid. The diameter of wall 22 is such as to provide a very small annular gap 24 between the inner wall of conduit 14 and wall 22. Typically, this diametric difference is of the order of $\frac{1}{8}$–$\frac{1}{4}$ inch.

When rod 11 is sonically excited at a resonant frequency, the acoustic energy effects pressure pulses in the liquid, the ball valves 20*a* and 20*b* responding to these pressure pulses to cause the pumping of liquid up the conduit. It is to be noted that rod 11 is vibrated in a longitudinal mode of vibration such that the valves do not respond directly to the vibration of the rod, but rather to the impulses developed in the liquid in response to rod vibration. Thus, the valves open and close in response to the pressure pulses in the fluid as they appear at each valve element to make for more efficient pumping action. It is to be noted that the liquid annulus 24 not only provides a fluid dynamic seal, but has the additional advantage of damping out unwanted lateral vibrational outputs of the rod string.

Figure 4:
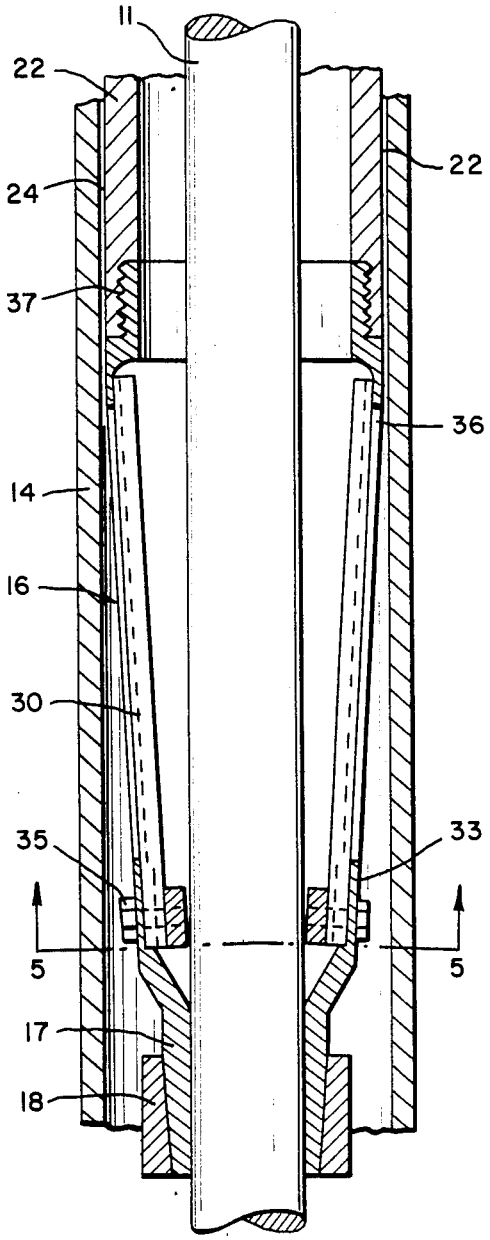
FIG. 4 is a cross-sectional view in elevation of a second embodiment of the invention.
Figure 5:
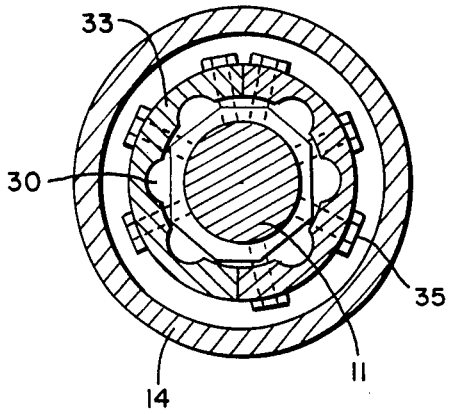
FIG. 5 is a cross-sectional view taken along the plane indicated by 5—5 in FIG. 4.
Figure 6:
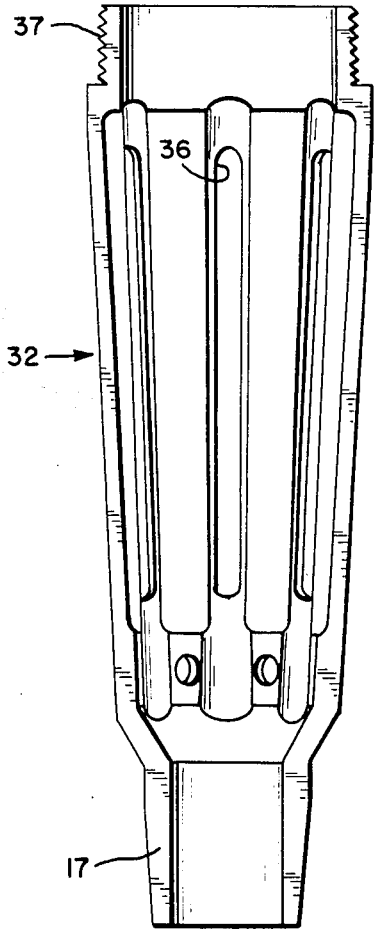
FIG. 6 is a side elevational view illustrating the valve body of the embodiment of FIG. 4.

Referring now to FIGS. 4–6, a second embodiment of the invention is illustrated. This embodiment employs reed-type valves in lieu of the ball valves of the prior embodiment. As for the prior embodiment, an elongated annular gap 24 is formed between wall portion 22 of the impeller element 16 and the inner wall of conduit 14. Also, as for the previous embodiment, the impeller element is cylindrical in construction and has a narrowed neck portion 17 which is tightly clamped to the rod member 11 by means of clamp member 18. The valves in this embodiment, however, rather than being formed by ball members, employ a plurality of reed members 30 which are fabricated of a suitable elastic material such as nylon. Reed members 30 are clamped to neck portion 17 by means of circular clamp 33 in conjunction with bolts 35. The reed members 30 are thus clamped at one end thereof and are otherwise free. Each of reeds 30 is installed over a slot 36 formed in the impeller wall and are installed so that they are normally in a position so as to close the slots. Valve body 32 has a threaded indent 37 on one end thereof to which the elongated wall portion 22 is threadably attached. Thus, in response to the sonic impulses generated in the fluid, the reeds periodically open and close the slots to permit the passage of fluid through the slots to implement the pumping action. The elasticity of the reeds provides fast response to accomodate the sonic operation frequency of the pump and thus affords highly efficient pumping action.

Figure 8:
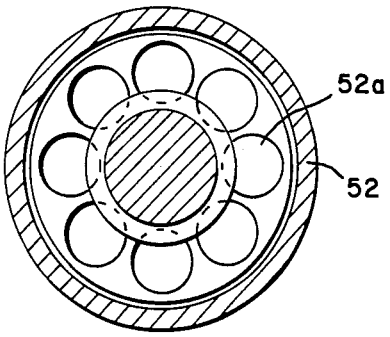
FIG. 8 is a cross sectional view taken along the plane indicated by 8—8 in FIG. 7.
Figure 9:
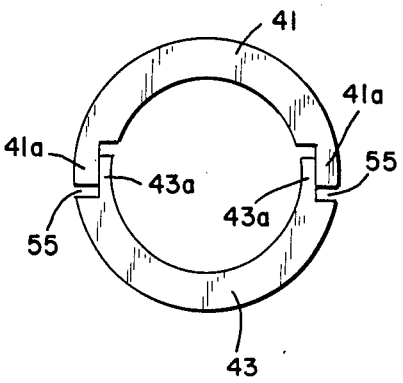
FIG. 9 is a cross sectional view taken along the plane indicated by 9—9 in FIG. 7.
Figure 7:
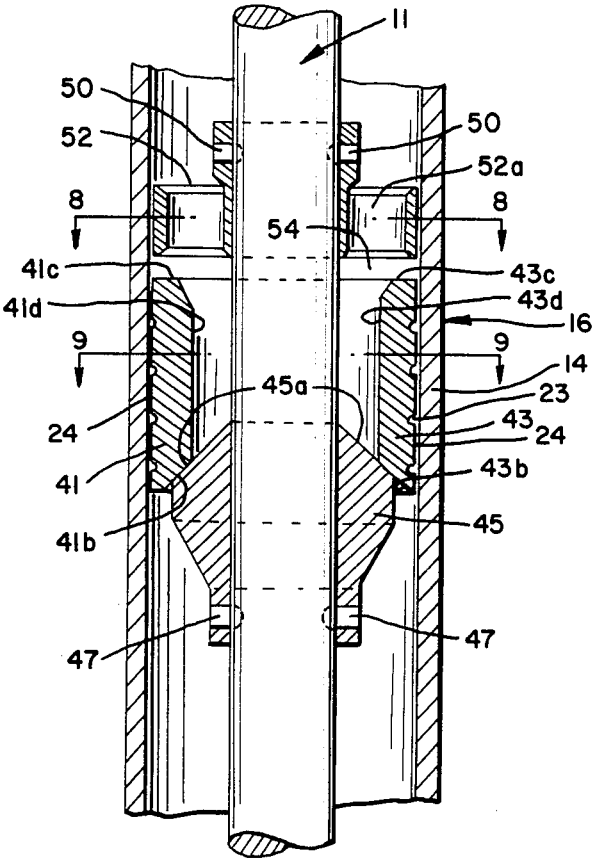
FIG. 7 is an elevational view in cross section of a further embodiment of the invention.

Referring now to FIGS. 7–9, a further embodiment of the invention is illustrated. This embodiment is particularly suitable for use in situations where the inside diameter dimensions and roughness of the tubing have substantial variations which may be occasioned by wide tolerances in manufacture, or in appreciably worn tubing where the wear from joint to joint is not uniform. Such variations are accomodated for in this embodiment by making the impeller elements in arcuate segments that are free to expand or contract radially so that they can be brought into very close proximity to the inner wall of the conduit during each pressure pulse, with fluid film in the annular gap thus being momentarily made quite thin to form the necessary high acoustical impedance to effectively block back flow past the impeller, particularly during the portion of the vibration cycle when the upward impelling impulse is occuring. The segmented free floating element also performs the function of a check valve impeller in conjunction with longitudinal freedom of stroke provided relative to a valve seat.

Referring to the figures, as in the previous embodiments, solid rod member 11 is suspended within conduit 14 which forms the channel for pumping the fluid in a well in which the conduit is installed. Further, as for the previous embodiments, a sonic oscillator as shown in my '554 patent, is employed to resonantly vibrate rod 11 in a longitudinal mode of vibration. Also, a plurality of sonic impeller units 16 are spaced along rod member 11 as in the previous embodiments. Each impeller element 16 includes a pair of arcuate segments 41 and 43, which together, form a cyclindrical sleeve. The segments 41 and 43 have overlapping lip portions 41*a* and 43*a*, respectively, which overlap each other and permit sliding motion between the two segments. Thus, segments 41 and 43 are free to expand outwardly towards the inner wall of conduit 14, and to move inwardly away from the wall in response to the forces generated in the system as described below. Annular grooves 23 are formed around the outer wall of the cyclindrical sleeve with an annular gap 24 being formed between the outer wall of the sleeve and the inner wall of conduit 14. Annular gap 24 is typically of the order of thousandths of an inch during the operation of the device in view of the radially outward expansion of segments 41 and 43 in response to the forces placed thereon. Therefore, in order to accomplish the desired end results of providing a blocking acoustical impedance to backflow, the longitudinal dimensions of the sleeve segments 41 and 43 need only be of the order of several inches, and for minimum friction can be an inch or less.

Bushing 45 is fixedly attached to rod 11 by means of pins 47. The slanted bottom surfaces 41*b* and 43*b* of the segments form a mating "valve" surface with surface 45*a* of the bushing. A stop member 52 is fixedly attached to rod 11 by means of pins 50 and operates to limit the upward longitudinal motion of the sleeve formed by segments 41 and 43. Stop member 52 has a plurality of apertures 52*a* to permit the flow of fluid therethrough.

Operation of the impeller device is as follows:

On the upstroke of rod 11 in response to the sonic energy, surface 45*a* engages mating surfaces 41*b* and 43*b*, thereby effectively closing the "valve" formed between these mating surfaces. At the same time, a pressure pulse is provided in the liquid thereabove, this pulse simultaneously acting against the top surfaces 41*c* and 43*c* of the sleeve segments, assuring tight closure of the "valve" formed between surfaces 45*a* and surfaces 41*b* and 43*b*. This assures a strong, upward pressure pulse for pumping the liquid up the conduit.

If the cylindrical sleeve valve member is made of an elastomeric material the two halves 41 and 43 may be formed as one virtually full circle single unit with only one longitudinal opening or expansion joint 55. Such a single cut circular configuration utilizing elasticity can expand or contract or bend to fit the conduit 14 sufficiently closely to provide said high acoustic impedance small gap 24.

Stop member 52 limits the longitudinal upward stroke of sleeve segments 41 and 43 during the "coasting" phase of the pumping cycle permitting the vertically energized liquid to coast through apertures 52*a*, and at the same time, minimizing the travel of the segments so that the time necessary for downward travel to close the "valve" will be minimized. The gap 54 between stop member 50 and the sleeve segments, is typically of the order of $\frac{1}{8}$–$\frac{1}{2}$ inch.

Figure 10:
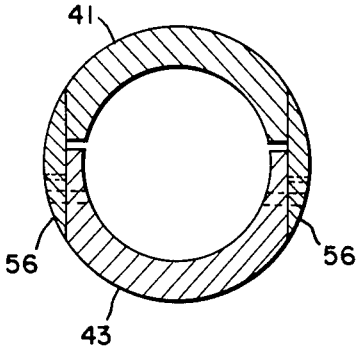
FIG. 10 is a cross sectional view of a modified form of the sleeve assembly of the embodiment of FIGS. 7–9.
Figure 11:
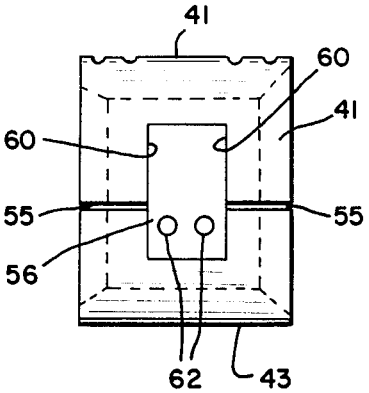
FIG. 11 is a side elevational view of the sleeve assembly of FIG. 10.

Referring now to FIGS. 10 and 11, a modification of the embodiment of 7–9 is illustrated for use in pumping low viscosity liquids such as in wells having a high percentage of water mixed with crude oil. This modification operates to seal off the gaps 55 formed between the segments (see FIG. 9), which typically are of the order of $\frac{1}{8}$–$\frac{1}{2}$ inch. Particularly with worn tubing, gaps 55 can become great enough during the vibration cycle to permit considerable leakage of low viscosity liquid. This problem is remedied by fastening seal tab inserts 56 to sleeve segment 43 by means of pins 62, these inserts fitting into mating grooves 60 formed in segment 41. This effectively seals off gap 55 while at the same time permitting radial movement between segments 41 and 43.

While the invention has been described and illustrated in detail, it is to be clearly understood that this intended by way of illustration and example only, and is not to taken by way of limitation. The spirit and scope of the invention being limited only by the terms of the following claims.

I claim:

1. A pumping system for pumping fluid out of a well comprising a tubing string for conducting said fluid, said tubing string running down said well, a rod string fabricated of elastic material contained within said tubing string and running therealong, said rod string being spaced from the tubing string, vibration generator means for providing vibrational energy to said rod string at a frequency such as to effect resonant standing wave vibration of said rod string, and a plurality of sonic impeller elements fixedly mounted on said rod string at spaced intervals therealong, said impeller elements each having a cylindrical sleeve with an elongated cylindrical body portion with an outside diameter slightly less than the inside diameter of said tubing string to form a narrow annular gap therebetween, said annular gap filling with said fluid to form a fluid annulus, said fluid annulus presenting acoustic mass impedance which provides a fluid dynamic seal against leak back flow past said body portion, the sonic energy effecting pumping action of the impeller elements to pump the well fluid up said tubing string.

2. The system of claim 1 wherein said impeller elements include a plurality of check valve means formed therein for passing fluid in response to lateral fluid pressure pulse components acting substantially normal to the longitudinal axis of the rod string.

3. The system of claim 2 wherein said check valve means comprises a plurality of elastic elongated reed elements, slots formed in the body of said impeller elements corresponding to said reed elements, and means for supporting said reed elements in positions opposite said slots to normally close said slots, said reed element being driven by said lateral fluid pressure pulse components to open said slots to permit the flow of the fluid therethrough.

4. The system of claim 3 wherein the means for supporting the reed elements comprises clamp means for clamping one of the ends of said reed elements to the body of the impeller element.

5. The system of claim 2 wherein the check valve means comprises a plurality of ball valves, there being mating valve seats for said ball valves formed in the bodies of said impeller elements in which the ball valves are normally seated, said ball valves being driven by the lateral fluid pressure pulse components to open the valves to permit the flow of said fluid therethrough.

6. The system of claim 5 wherein the ball valves are arranged in sets around the circumference of said cylindrical body.

7. The system of claim 1 wherein said impeller elements are attached only at one end thereof to said rod string.

8. The system of claim 1 wherein the cyclindrical body of said impeller elements is adapted to move outwardly towards the tubing string in response to the vibrational energy to narrow the fluid annulus therebetween, there further being valve surfaces fixedly attached to said rod string, said impeller elements having surfaces formed thereon which matingly engage with said valve surfaces in response to said vibrational energy, thereby forming check valves.

9. The system of claim 8 wherein said cyclindrical bodies are each formed from overlapping mating half segments capable of moving radially relative to each other.

10. The system of claim 9 wherein gaps are formed between the overlapping portions of said segments and further including insert tabs installed on said segments to close said gaps.

* * * * *